United States Patent [19]

Grimm

[11] 4,333,601

[45] Jun. 8, 1982

[54] ALUMINUM FOIL LINED PACKAGE, PARTICULARLY SUITABLE FOR OIL- AND FAT-CONTAINING PRODUCTS

[75] Inventor: Jakob Grimm, Langnau-Emmental, Switzerland

[73] Assignee: Inauen Machinen AG, Herisau, Switzerland

[21] Appl. No.: 227,086

[22] PCT Filed: Apr. 28, 1980

[86] PCT No.: PCT/CH80/00050

§ 371 Date: Jan. 2, 1981

§ 102(e) Date: Dec. 30, 1980

[87] PCT Pub. No.: WO80/02412

PCT Pub. Date: Nov. 13, 1980

[30] Foreign Application Priority Data

May 2, 1979 [CH] Switzerland ..... 4094/79

[51] Int. Cl.[3] ..... B65D 5/56; B65D 5/64

[52] U.S. Cl. ..... 229/43; 220/450; 229/3.5 MF; 426/106; 426/126; 426/130

[58] Field of Search ..... 426/126, 130, 129, 396, 426/398, 106; 229/3.5 MF, 1.5 B, 43, 2.5 R; 220/450

[56] References Cited

U.S. PATENT DOCUMENTS

| | | | |
|---|---|---|---|
| 1,955,745 | 4/1934 | Hurley | 220/450 |
| 2,555,380 | 6/1951 | Stuart et al. | 229/3.5 MF |
| 2,745,752 | 5/1956 | Peters | 426/130 |
| 2,808,192 | 10/1957 | Raisin | 426/126 |
| 2,828,903 | 4/1958 | Adkins | 220/450 |
| 2,842,301 | 7/1958 | Albert | 229/1.5 B |
| 2,853,222 | 9/1958 | Gallagher | 229/1.5 B |
| 2,917,215 | 12/1959 | Psaty et al. | 229/1.5 B |
| 3,049,277 | 8/1962 | Shappeli | 229/3.5 MF |
| 3,298,559 | 1/1967 | Lurie | 229/3.5 MF |
| 3,403,837 | 10/1968 | Farquhar | 220/450 |
| 3,750,827 | 8/1973 | Wick | 229/3.5 MF |
| 3,946,872 | 3/1976 | Sturm | 229/3.5 MF |
| 4,008,848 | 2/1977 | Christensson | 220/450 |

FOREIGN PATENT DOCUMENTS

| | | | |
|---|---|---|---|
| 450271 | 4/1968 | Switzerland . | |
| 475883 | 9/1969 | Switzerland . | |
| 1126292 | 9/1968 | United Kingdom | 220/450 |

*Primary Examiner*—Steven L. Weinstein

*Attorney, Agent, or Firm*—Karl F. Ross

[57] ABSTRACT

Improved packaging, particularly suitable for dairy products, is disclosed. A plastic container is lined with aluminum foil in order to give better protection of the contents against light, oxygen and evaporation, and it protects the container against heat during filling. The container is closed by sealing an aluminum top thereon. The sealing area can be arranged in a variety of ways on the edge of the container between the aluminum top and an exposed portion of the plastic container. The aluminum foil can form a collar, which may be sealed between the container and its top.

2 Claims, 4 Drawing Figures

ALUMINUM FOIL LINED PACKAGE, PARTICULARLY SUITABLE FOR OIL- AND FAT-CONTAINING PRODUCTS

FIELD OF THE INVENTION

This invention relates to a packaging particularly suited for products containing oil and fat, for example dairy products, cosmetic products and pasty foodstuffs.

BACKGROUND OF THE INVENTION

The packaging of products containing oil and fat, in particular of dairy products, has to meet a number of different requirements. These requirements, all of which deals with protection to the contents, are briefly described as follows:

(a) Protection Against Light

Foodstuffs sensitive to light, for example products containing fat and oil, suffer from exposure to light during storage and deteriorate in quality, often after a relatively short time. Ultra-violet light rays promote oxidation of the fat and oil components, which is detrimental to taste and olfactory qualities, and results in inedibility. At the same time, other substances such as vitamins and proteins are destroyed.

(b) Protection Against Dehydration

The water vapor permeability of the packaging should be as low as possible. Products containing water, as for example fats, butter, margarine and cream cheese, are adversely affected by loss of water; deterioration results in the edges and surfaces of the packaged product becoming darker and glassy.

(c) Protection Against Oxygen

Exposure to oxygen promotes oxidation reactions and the effects mentioned in paragraph (a) above.

(d) Temperature Resistance

The packaging should be able to withstand as high a filling temperature as possible so that sterile filling can be ensured.

(e) Dimensional Stability

The packaging should be compression-and shock-proof to as high a degree as possible, to protect the product during transport and storage.

All the above requirements are only partly met by packagings generally known heretofore.

The well-known packages, consisting of plastic containers with aluminum tops, are not light-proof at the sharply-formed edges and corners. They do not allow hot filling, and many of the packages show unsatisfactory degrees of water vapor and oxygen impermeability.

All-aluminum packages have the substantial drawback of being extremely susceptible to shock and compression. Therefore, often costly and voluminous bulk packages are needed for transport and storage of products thus packaged.

Recently, packages of laminated foil have been introduced on the market. Packages of this kind combine the advantages of the previously-mentioned methods of packaging, but there are still drawbacks. Mainly, laminated foils allow very little forming. In order to obtain a tray, for example, deep-drawing in several stages is necessary. Even then, the ratio between the surface and depth is not nearly as good as for conventional plastic containers. As a result, deep-drawing, filling and sealing equipment are not efficiently utilized.

OBJECT OF THE INVENTION

It is the present invention to meet the aforementioned requirements, and alleviates the disadvantages of laminated foil packaging.

SUMMARY OF THE INVENTION

According to the invention there is provided a packaging consisting of a generally cup-shaped plastic container having a horizontal edge and an aluminum foil lining which can cover the contents of the container at least over the extent of the plastic container.

BRIEF DESCRIPTION OF THE INVENTION

The accompanying drawing shows preferred embodiments of the packaging according to the invention which are described below. In the drawing.

SPECIFIC DESCRIPTION

Figure 1:
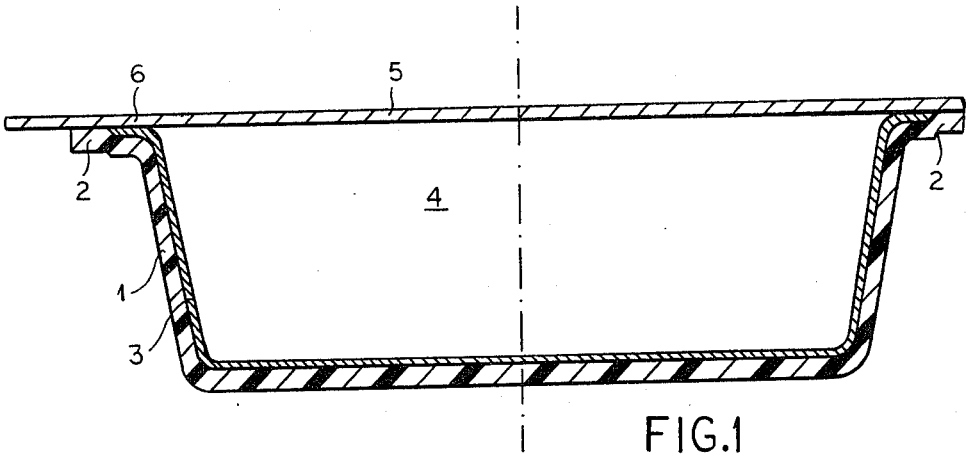
FIG. 1 shows a cross-section of packaging according to the invention.

In the drawing, the plastic container—generally cup-shaped—is indicated by the reference numeral 1. The shape of the cup, however, is of no consequence to the invention. Edge 2 of the container 1 lies generally in one plane. Cup 1 is lined with aluminum foil 3. Product 4 is filled into the lined container. Container 1 is sealingly closed by a cover 5. The product 4 is hermetically sealed in by sealing along the sealing area 6.

Figure 2:
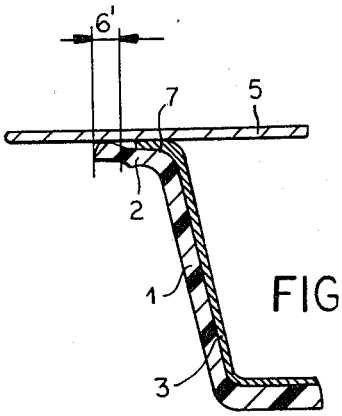
FIGS. 2–4 show details of the packaging in cross-section, representing various closing methods.

Several variations of this basic arrangement are possible. In FIG. 2 the aluminum foil 3 extends onto the planar edge 2 of container 1, and forms a collar 7 which lies between edge 2 and the cover 5 of aluminum. The sealing area 6' extends along the extreme end of edge 2. Sealing takes place directly between the aluminum top and plastic container.

Figure 3:
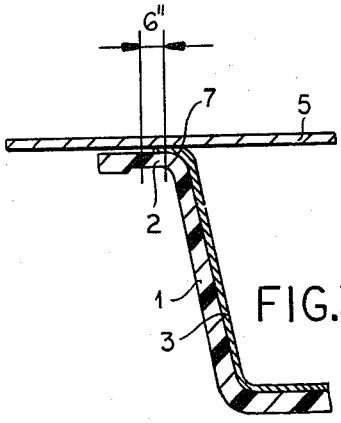

In FIG. 3 also aluminum foil 3 extends to form a collar 7. Contrary to the embodiment shown in FIG. 2, sealing area 6'' is located inwardly of the end of edge 2, and sealing is effected between aluminum top 5 and edge 2 of plastic container 1 through collar 7 of foil 3.

Figure 4:
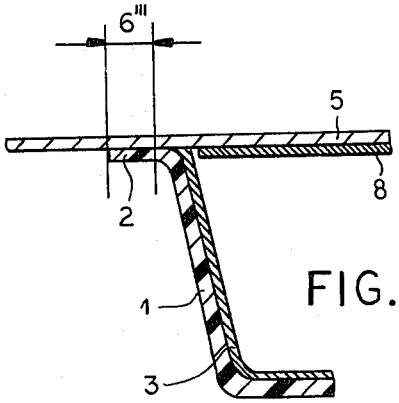

It is also possible, however, to do without collar 7 on foil 3, as shown in FIG. 4. The potential sealing area 6''' is thus enlarged. Sealing is again effected directly between edge 2 and top 5. Basically, the sealing area can now be as wide as the edge of plastic container 1. It is also possible to place an aluminum foil 8 between top 5 and contents 4. This foil 8 may adhere to the aluminum top 5 so that the foil comes off together with the top. It may also cover the edge 2 partly or entirely, in a manner similar to collar 7, and thus be sealed to the plastic container or not, as desired. Top 5 may also be a snap lid or aluminum foil laminated with paper.

The packaging according to the invention meets the requirements discussed herein, is inexpensive to produce and requires to special equipment.

The packaging according to the invention combines the recognized advantages of plastics film and aluminum foil packages, but without the disadvantage of laminated foils.

Conventional plastic containers can withstand a filling temperature of only about 85° C. Higher filling temperatures, as for instance 95° C., lead to heavy distortion of such containers. Although aluminum is a good heat conductor, it has been found that the aluminum foil lining according to the present invention protects the plastic container from distortion, even at a filling temperature of 95° C.

The embodiments of the invention in which an exclusive property or privilege is claimed are defined as follows:

1. A food-packaging container comprising an upwardly open cup-shaped receptacle having an outer plastic layer and an inner aluminum foil lining, said receptacle having downwardly tapering walls, a base unitary with said walls and an outwardly directed horizontal flange surrounding a mouth of said receptacle and lying in plane, said plastic layer extending to the outer periphery of said flange and said lining extending over the entire base and walls and having an outwardly directed portion overlying said layer of said flange but terminating inwardly of said periphery whereby a peripheral zone of the material of said layer is exposed from above on said flange, and an aluminum cover closing said mouth of said receptacle and extending over said zone and bonding directly to said layer at said zone.

2. The container defined in claim 1 wherein an inner aluminum foil layer adhering to said cover is disposed within the mouth of said receptacle.

* * * * *